US010490062B2

(12) United States Patent
Neumann et al.

(10) Patent No.: US 10,490,062 B2
(45) Date of Patent: Nov. 26, 2019

(54) REMOTE CONTROL FOR AUTOMOTIVE APPLICATIONS

(71) Applicant: Hella GmbH & Co. KGaA, Lippstadt (DE)

(72) Inventors: Andreas Neumann, Lippstadt (DE); Ludger Weghaus, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 15/778,103

(22) PCT Filed: Nov. 16, 2016

(86) PCT No.: PCT/EP2016/077881

§ 371 (c)(1),
(2) Date: May 22, 2018

(87) PCT Pub. No.: WO2017/089202

PCT Pub. Date: Jun. 1, 2017

(65) Prior Publication Data

US 2018/0342152 A1 Nov. 29, 2018

(30) Foreign Application Priority Data

Nov. 24, 2015 (EP) ..... 15196052

(51) Int. Cl.
*G08C 17/02* (2006.01)
*G07C 9/00* (2006.01)
*G08C 17/00* (2006.01)

(52) U.S. Cl.
CPC ..... *G08C 17/02* (2013.01); *G07C 9/00309* (2013.01); *G08C 17/00* (2013.01);
(Continued)

(58) Field of Classification Search
CPC .... G08C 17/02; G08C 17/00; G08C 2201/32; G08C 2201/71; G08C 2201/91; G07C 9/00309; G07C 2009/00507
See application file for complete search history.

(56) References Cited

U.S. PATENT DOCUMENTS

2004/0141014 A1* 7/2004 Kamiwada ..... G06F 3/04815 715/848
2008/0204404 A1* 8/2008 Kneissler ..... G06F 3/0317 345/156

(Continued)

FOREIGN PATENT DOCUMENTS

EP 0357909 A1 3/1990
FR 2814842 A1 4/2002

(Continued)

OTHER PUBLICATIONS

Bronshtein, I. N. "Handbook of Mathematics 5th Edition." (2017), Chapter 3.3.1 and 3.5.4.3.

*Primary Examiner* — Thomas D Alunkal
(74) *Attorney, Agent, or Firm* — Husch Blackwell LLP

(57) ABSTRACT

A method for remote controlling an object with a remote-control unit is provided. At least a first surface $S_1$, $S_2$, $S_i$ is defined in a first coordinate system. At least a first function of the object is associated to the first surface $S_1$, $S_2$, $S_i$. A second coordinate system is defined at the position of the remote-control unit. A static pointing vector 28 is defined in the second coordinate system. It is then determined whether the pointing vector points towards the first surface $S_1$, $S_2$, $S_i$. If so, the object is enabled to selectively activate the first operation upon receipt of an activation command.

13 Claims, 3 Drawing Sheets

(52) U.S. Cl.
CPC ..... *G07C 2009/00507* (2013.01); *G08C 2201/32* (2013.01); *G08C 2201/71* (2013.01); *G08C 2201/91* (2013.01)

(56) References Cited

U.S. PATENT DOCUMENTS

| | | | | |
|---|---|---|---|---|
| 2008/0265143 | A1* | 10/2008 | Peters | G06F 3/0304 250/221 |
| 2009/0116691 | A1* | 5/2009 | Scholl | G08C 17/00 382/103 |
| 2009/0295595 | A1* | 12/2009 | Thelen | G08C 17/02 340/12.52 |
| 2015/0309126 | A1* | 10/2015 | Jung | G01R 33/0206 702/150 |

FOREIGN PATENT DOCUMENTS

| | | | |
|---|---|---|---|
| WO | 03/056531 | A1 | 7/2003 |
| WO | 2006/018776 | A1 | 2/2006 |
| WO | 2014/053411 | A1 | 4/2014 |

* cited by examiner

REMOTE CONTROL FOR AUTOMOTIVE APPLICATIONS

CROSS REFERENCE

This application claims priority to PCT Application No. PCT/EP2016/077881, filed Nov. 16, 2016, which itself claims priority to European Patent Application No. 15196052.3, filed Nov. 24, 2015, the entirety of both of which are hereby incorporated by reference.

FIELD OF THE INVENTION

The invention relates to remote control an object having at least one function that can be selectively enabled and/or disabled with a remote-control unit.

BACKGROUND

Cars often have a wireless access control with an electronic key and an electronic lock. These keys, comprise a transponder for exchanging data with a control unit of the car via radio frequency (RF) signals to verify that the key 'matches' the car. If the key matches, the doors are unlocked or locked and/or the engine is started upon demand. Early systems unlocked or locked all doors when a user pushed an unlock button or a lock button, respectively of the key. Thus the function of locking/unlocking of the door was associated to the respective button. Currently, there are systems available that measure the distance of the key to doors and open only the door being next to the key.

As suggested e.g. in WO 2014/053411 the key may as well be used to remote control additional functions of the car, e.g. opening or closing of a window or a trunk lid, switching parking lights on or off, opening a garage door and the like. These additional functions are associated to a particular movement of the key in space which is detected by acceleration sensors. These movements replace actuating a corresponding push-button being associated with the corresponding function. In addition, the position of the key is determined and used to determine which door or window is next to the key, to activate that particular window or door lock if a corresponding command is detected.

SUMMARY OF THE INVENTION

The problem to be solved by the invention is to make remote control of objects like for example cars more intuitive.

The invention is based on the observation that prior art remote-control units select the door to unlock or the window to lower or raise by a distance measurement. Thus the user has to significantly change its position if he intends to open e.g. the left front door but approaches the car from its back.

According to the invention, one may simply point with a remote-control unit to a surface of the car, e.g. point to the particular door one wants to open and presses as usual the unlock button to thereby provide an activation command for unlocking the car. The system measures the orientation of the remote-control unit relative to the car to thereby determine if the remote-control unit points, e.g. with its front end or a marker being attached to or printed on the housing of the remote-control unit to a particular door or an area, e.g. around a door handle. Only that door is unlocked upon a corresponding command from the remote-control unit, to which the remote-control unit points to. Of course, as usual the car, i.e. a corresponding controller may check if the remote-control unit is authorized for unlocking the doors or to activate other functions which are associated to a surface the remote-control unit points to and only if it is authorized, the control is granted. In this scheme, a car is only an example for a remote-controllable object, e.g. a manufacturing machine, a robot, a boat. In the example of a car typical functions would be 'unlock left front door', 'open/close trunk', 'unlock/lock right front door', to name only a few. This scheme can of course be generalized to any kind of remote-control for an object. With respect to a robot, a function could be, a predefined sequence of movements, e.g. for positioning an item.

The direction the marker or the front end points to can be represented by a pointing vector in the remote control's coordinate system. Or in other words, the position of the pointing vector in the object's coordinate system can be considered as the position of the remote-control unit (eventually with a constant offset). The direction of the pointing vector in the object's coordinate system is thus representative for the orientation of the remote-control unit.

A method for implementing this scheme may comprise at least some of the following steps: In an early, e.g. as first step, a first coordinate system is defined. This is the object's coordinate system. If the object is movable like a car or boat, its coordinate system thus translates and rotates as the object translates and rotates, respectively. Further, at least a first surface is defined in said coordinate system. The surface can be e.g. the surface of a car's door or a window. The surface can as well be the shell surface of the object or a part thereof. This first surface is associated to a first function. The first function could be, to stay in the example of a car "actuate door lock" or "actuate window drive" or in the example of a machine "move lever". Now the orientation of the remote-control unit relative to the object, is determined. To this end a vector is defined in the remote-control unit's coordinate system, which is referred to as second coordinate system. The vector thus translates or rotates as the remote-control unit is moved in space, i.e. translated or rotated, respectively. The vector may, e.g. be a vector pointing in the forward direction of the remote-control unit if held in the hand as intended. For ease of reference this vector is referred to as 'pointing vector', but it has nothing to do with the 'Poynting Vector' in electrodynamics. It is simply a vector pointing in a defined direction in the second coordinate system. Preferably, the direction of the pointing vector is indicated on a housing of the remote-control unit, e.g. by a marker or the front end. Directing of the pointing vector to a particular surface can be accomplished by simple rotation of the remote-control unit by the user.

Briefly, a static pointing vector is defined in said second coordinate system. Static simply implies that the pointing vector's coordinates are constant in the second coordinate system. The pointing vector is not static in the first coordinate system, as the first and second coordinate systems are movable relative to each other. If the pointing vector is given using the coordinates of the second coordinate system this is referred to as 'being represented in the second coordinate system' or 'being defined in the second coordinate system'. As explained below in more detail, the pointing vector can as well be expressed in the first coordinate system. In this case, it would be represented in the first coordinate system.

The pointing vector is thus indicative of the orientation of the remote control unit in space. The starting point of the vector (or alternatively its tip) is indicative of the position of the remote-control unit. The method further comprises determining the pointing vector's orientation in the first coordinate system. Mathematically this means determining the rotation matrice that aligns the bases of the first and second coordinate systems. Preferably, as well the position of the pointing vector, and thus the remote-control unit is determined in the first coordinate system as explained below in more detail. Knowing the position and the orientation of the pointing vector in the first coordinate system enables to determine, if the pointing vector points towards a surface being defined in the first coordinate system. Alternatively, the respective surface could be represented in the second coordinate system. But in any case the relation between the first and second coordinate systems must be determined, i.e. the translation and the rotation to map the two coordinate systems. Determining the translation and thus the position of the remote-control unit in the first coordinate system (which is equivalent to determining the position of the object in the second coordinate system) can be obtained by triangulation and/or trilateration.

Next, it is determined, if the pointing vector points towards the first surface. For example the pointing vector may be extended (at least) in the direction it points to and it may be determined if the extension intersects said first surface. If yes, it points towards the respective surface if not, it points in a different direction.

If the pointing vector points towards the first surface and if an activation command is provided by the user, than the first function may be activated. Further conditions may apply as explained below. Activation of the first function means to energize to an actuator, e.g. a linear drive for lowering a window. Activation of a first function may of course as well include cutting the energy supply to stop a movement or the enable a spring to relax and to thereby move an item. In the above example where the object is a car, the respective door may be locked (or unlocked) or the respective window may opened or closed by activating the respective drives.

As indicated above, the method may further comprise associating at least a second operation to a second surface, i.e. a second function to a second surface. By pointing towards the second surface the activation command may activate the second function. Generally speaking one may say that pointing with the pointing vector to a surface being associated by to a function enables to activate the respective function by an activation command.

Summarizing, if the pointing vector points towards a surface being associated to a particular function and if an activation command is received by the remote-control unit or the object, the corresponding function is activated. Of course it is understood that the two events of pointing and receiving the activation command should take place at the same time or in a predefined time interval which may depend on the function.

Thus, the activation command may be an abstract activation, as the activation command does not necessarily comprise the information which function to operate (but it may comprise it). For example the activation command can be valid for a number of functions and only the function being associated to the surface being pointed to by the pointing vector is activated, e.g. by the object's control unit. The user may for example point with the remote-control unit to a surface of the item and provide an activation command, e.g. by pressing a push button. The system then determines if a function is associated to the surface the remote-control unit points to and activates the corresponding function. The function being activated by the system is thus a response on the orientation of the remote-control unit relative to the first coordinate system.

For example, the pointing vector can be selected to have a given length, e.g. 5 m or 10 m and a function is only activated upon demand, if the pointing vector intersects a surface being associated with the respective function. In other words, a function is selected for activation by directing the pointing vector in the direction of the surface being associated to said function and if the distance between the remote-control unit and the surface is smaller than the length of the vector. This would prevent to activate a function if the user is still too far away from the object.

Alternatively, a surface being associated to a particular function may as well be associated with a maximum and/or minimum distance. In this case the particular function can be activated by the respective command only, if the distance between a reference point in the first coordinate system and a reference point in the second coordinate system is below the maximum distance and/or above the minimum distance and if the pointing vector points towards said surface. The reference point in the first coordination system, may be e.g. a point in the respective surface. The reference point may be defined for each surface and thus for each function. The reference point in the second coordinative system may be e.g. it origin or the starting point of the pointing vector. The distance between the two reference points is thus a measure for the distance between the object (eventually with an offset) and its remote-control unit. To make it more vivid: A surface being associated e.g. to opening a trunk lid may be associated to a minimum distance of e.g. 50 cm or the like to avoid that the user gets hit by the trunk lid, when the trunk lid is opened automatically. Further, a surface being associated to a door lock may be associated to a maximum distance of e.g. 100 m, to avoid that the door is unlocked if the user is still too far away from the door to survey it. Beyond, functions being associated to overlapping surfaces (or surfaces with overlapping projections) may be selected upon the distance of the remote-control unit and the object or the respective surfaces by defining non-overlapping maximum and minimum distances.

The activation command can e.g. be provided by simply pressing a push-button. The push-button is only an example for an input receiving means. A single simple push button (=input receiving means) may thus be used to activate two or more functions, which are selected by direction the pointing vector in the direction of the surface being associated with the respective function. Other input receiving means for receiving an activation command by a user may be used as well, e.g. a speech recognition module, a finger print sensor or the like.

The direction of the pointing vector may be visualized, e.g. by a light beam pointing in the direction of the vector, e.g. a laser beam. More generally, a selection of a particular function may be visualized prior to providing an activation command. For example, the remote-control unit may comprise a light source for providing a light beam, e.g. a laser source. The corresponding light beam enables to precisely point to a particular surface. The light beam may be activated upon demand by the user, e.g. by the same input-receiving means, for example the above named push-button. For example, a first activation of the input-receiving means enables the light beam and second activation provides the activation command for a function being selected by pointing on the respective surface. Said second activation of the input receiving means may deactivate the light source.

Use of the remote-control unit is simplified, if the remote control unit indicates that the pointing vector points to the first or any further surface. To this end the object may determine as explained above, if the extension of the pointing vector intersects the first surface or any other surface being associated to a respective function being controllable by the remote-control unit, or if not. The result may be provided to the remote control unit, e.g. by an RF-communication channel, and indicated to the user. Of course, the remote-control unit may as well determine if the pointing vector points to one of the surfaces. If the user subsequently provides the activation command, the corresponding function is activated. Summarizing, the method may further comprises visualizing or otherwise indicating if the pointing vector points towards said first surface prior to receiving an activation command, for example by illuminating an item of the object, wherein the item is associated to the first function, if the pointing vector points to the first surface. As well, an indication means of the remote-control unit, like a light source or a display, may be activated wherein the indication means is associated to the first function in case the pointing vector points to the first surface.

In a very simple embodiment, a LED (or any other light source) may indicate if the pointing vector points to at least one of the surfaces. In a more sophisticated embodiment, the remote control as well indicates which function is selected by the direction of the pointing vector. For example, the remote-control unit may have multiple light sources, for example one light source for each function. Another option is to display a selected function using a display being integrated in the remote-control unit.

A further preferred example of visualizing if a function is selected by directing the pointing vector to a particular surface, is to selectively illuminate an item being associated with the respective function. For example, if the user points the pointing vector to a surface being associated to a door lock (function=lock/unlock door), an item like e.g. the handle bar or the respective door(s) may be illuminated. A further example would be to switch the illumination of the rear license plate on, in case the pointing vector points to a surface being associated to the trunk lid. In this example the item is the rear license plate, which is illuminated if the user points to the surface being associated to the function "open/close trunk lid". In all these examples, a user is enabled to select a function by pointing to an associated surface and he receives a feedback about the selection prior to providing the activation command. This helps the user to clearly select a particular function, even in case that the associated surface is small and/or close to a surface being associated to another function.

In all these suggestions for visualizing if the pointing vector points towards the first or another surface or not, is advantageous to indicate, if the pointing vector's extension approaches the respective surface. For example if the distance between the extension and a surface is below a maximum, this may be visualized as well, e.g. by simply using a different color. Thus, going back to the example where a light source (e.g. a multicolor LED) indicates that the pointing vector points towards a surface or not, the LED may emit light of a first color, e.g. yellow light if the pointing vector's extension does not intersect the surface, but is already close (distance below maximum). If the remote-control unit is moved such that the pointing vector's extension intersects the respective surface, the light source may be switched to another distinguishable state for example to emit a second color, e.g. green, or start blinking.

In particular, if the object is a car, it is likely that the extension of the vector intersects the first surface and a second surface. For example, if a user is positioned right in front of the left door and aims for that door with the remote control to thereby direct the pointing vector towards the door, the pointing vector will point to a first surface being associated to the front left door and to a second surface being associated to the right front door. In a case where the pointing vector points in the direction of two surfaces, only that function is activated by the activation command that is associated to the surface which is closest to the remote-control unit. In the above example the left front door (should and) would be unlocked, only, although the vector as well intersects the surface being associated with the right front door. The object can select a particular function from a multitude of functions by including additional information about the remote-control's position in the first coordinate system. More generally, the method may further comprise testing if the pointing vector points towards the first surface and the second surface. In case it points to the first and second surfaces the system activates the first function only if the remote-control unit is closer to the first surface than to the second surface and/or the second function only if the remote-control unit is closer to the second surface than to the first surface.

A further possibility to select a surface from two or more surfaces that intersect with the vector's extension is to define front and rear sides of the surfaces and to activate the function being associated with the respective surface only in case the vector points to a predefined of said sides. This enables as well to implement security aspects, for example a lever of a machine should not swing in the direction of the user controlling the machine with the remote control. Going back to the example of a car and a user standing right in front of the left front door and pointing horizontally to that left front door, the extension of the vector would hit the outer side (=e.g. front side) of the first surface and the rear side of the second surface. Further, it is possible to ensure that a particular function is activated only if the vector points towards a predefined side of a surface.

The determining step may comprise providing (e.g. by generating) a first observable vector field by the object or at least in the first coordinate system. That is, if the object moves, the vector field moves accordingly. For example, the vector field may be an electromagnetic field and the observable vectors are e.g. the magnetic field vector and/or an electric field vector of said electromagnetic field. At the position $\vec{p}_r$ of the remote-control unit, the direction of a field vector of said vector field is measured by the remote-control unit in the second coordinate system. This measured field vector is compared to a predicted field vector at the position $\vec{p}_r$ of the remote-control unit. Only to avoid ambiguities, the position $\vec{p}_r$ is defined relative to the object, e.g. to the origin of the first coordinate system and can be determined by the object and/or the item or be provided by an external position indicating means. As alternative, the position of the object in the second coordinate system could be used as well.

The angles of rotation around the x, y and z axes between the measured and the predicted field vectors can be determined and correspond to the rotation of the second coordinate system relative to the first coordinate system, briefly:

$$R\vec{f}_1(\vec{p}_r)=\vec{f}_2(\vec{p}_r), \tag{1}$$

wherein R is the corresponding rotary matrix, $\vec{f}_1(\vec{p}_r)$ is the predicted field vector at $\vec{p}_r$ and $\vec{f}_2(\vec{p}_r)$ is the measured field vector at $\vec{p}_r$. The field vectors $\vec{f}_1(\vec{p}_r)$, $\vec{f}_2(\vec{p}_r)$ can be considered to be normalized, because they should have the same length. R can be represented as $$R(\alpha, \beta, \gamma)=R_x(\alpha)\cdot R_y(\beta)\cdot R_z(\gamma) \tag{2}$$

wherein $R_x(\alpha)$ is the rotary matrix for a rotation around the x-axis and $\alpha$ the corresponding angle of rotation, $R_y(\beta)$ and $R_z(\gamma)$ represent the rotary matrices for a rotation around the y, z axes with angles $\beta$, $\gamma$, respectively.

In 3D, the order of the matrix R is three and equation (1) has only three variables ($\alpha$, $\beta$, $\gamma$), it can thus be solved easily.

In practice, first the location $\vec{p}_r$ of the remote-control unit in the first coordinate system and the corresponding measured field vector $\vec{f}_2$ are determined. The remote-control unit preferably transmits the measured field vector $\vec{f}_2$ to the object, e.g. via an RF-communication channel. The object may determine the angles $\alpha$, $\beta$ and $\gamma$ and thereby the orientation of the second coordinate system relative to the first coordinate system. Accordingly, the orientation of the initially defined pointing vector $\vec{v}_{p_2}$ as defined in the second coordinate system may be expressed using the basis of the first coordinate system by applying the corresponding (inverse) rotation:

$$R^{-1}\vec{v}_{p_2}=R^{-T}\vec{v}_{p_2}=\vec{v}_{p_1}, \tag{3}$$

wherein $R^{-1}$ is the inverse of R, which can be obtained by simply transposing R, i.e. $R^{-1}=R^T=R(-\alpha, -\beta, -\gamma)$ and $\vec{v}_{p_1}$ is the point vector's representation in the first coordinate system.

Subsequently it can be determined if the pointing vector points to the first surface $S_1$ or more generally, if it points to any surface $S_i$ being associated to a particular function $F_i$, wherein i is an integer representing the number or the surface and the associated function. This determining may be done by checking if the pointing vector points to a surface $S_i$, i.e. by simply checking if there exists a positive number r such that the following equation holds true:

$$\vec{p}_r+r\cdot\vec{v}_{p_1}=S_{i1} \tag{4}$$

Again, $\vec{p}_r$ is the position of the remote-control unit (defined in the first coordinate system, i.e. $\vec{p}_r=\vec{p}_{r_1}$). The index 1 of $S_i$ indicates that the surface is represented in the first coordinate system. Of course the equation could as well be solved in the second coordinate system:

$$r\cdot\vec{v}_{p_2}=S_{i2}, \tag{5}$$

wherein $\vec{v}_{p_2}$ is the pointing vector in the second coordinate system, r a positive number and $S_{i2}$ the $i^{th}$ surface represented in the second coordinate system. Again, if a positive r exists, the pointing vector points towards the surface $S_i$. This is referred to as well as an extension of the pointing vector intersects the surface $S_i$.

The determining step may further comprise measuring a vector of an external vector field by the remote-control unit at its respective position. This provides an information about the orientation of the remote-control unit relative to the source of the external vector field and thus enables to compensate for incomplete or inaccurate measurements, i.e. for imperfections in the measurement of the direction of the field vector of the first vector being generated by the object. For example, if the first vector field is an electromagnet vector field, it is easier to determine only the absolute values of three linearly independent components (e.g. $|\vec{f}_{2x}|$, $|\vec{f}_{2y}|$ and $|\vec{f}_{2z}|$) of the field vector $\vec{f}_2$ of said first vector field than the sign, i.e. the orientation of the components, as the absolute values are a measure to the signal being received by the respective antenna. In a simple example, the first vector field is a low-frequency vector field and the antennas are (at least) three coils being oriented in three linearly independent directions for measuring the respective components. One usually measures the absolute value of the amplitudes of the signals, but this does not enable to determine the direction of the corresponding vector component. By including the information about the orientation of the remote control unit to a third reference system, e.g. the earth's coordinate system, one can exclude impossible solutions. For example, the external vector can be the earth gravity field or the earth magnetic field. The direction of these fields can be measured easily by of the shelf acceleration sensors or magnetic field sensors. The core idea is that the object's orientation in space is often known to a certain extent and that this information although having an uncertainty is sufficient to remove the uncertainty about the sign of the components. For example, a car is never operated 'upside down' and the slope of a street is limited to a few percent. Thus with an accuracy of, e.g. ±15°, the orientation of the z-axis of the first coordinate system is known in advance. Accordingly, starting from the estimation that the object is oriented 'upright' one can calculate an approximation of the angles $\alpha$, $\beta$ and $\gamma$ by solving $$R\vec{g}_1=\vec{g}_2(\vec{p}_r), \tag{6}$$

wherein $\vec{g}_1$ is the normalized estimated gravity vector of the object in the first coordinate system and $\vec{g}_1(\vec{p}_r)$ is the normalized gravity vector as measured by the remote-control unit. The approximation of $\alpha$, $\beta$ and $\gamma$ resolves the uncertainty about the signs of the components (e.g. $\vec{f}_{2x}$, $\vec{f}_{2y}$ and $\vec{f}_{2z}$) of the field vector, as a change of a sign of a component transforms in a rotation of 180° and the uncertainty of the estimation of the gravity vector is much smaller.

A further method for determining the matrix R (or $R^{-1}$) is to measure a vector of an external vector field by the remote-control unit and by the object at their respective positions, again these measurements can be represented by field vectors $\vec{f}_1$, $\vec{f}_2$. For example both could measure the direction of the (earth) gravity field e.g. by acceleration sensors at their respective positions. It may be assumed, that the two measured gravity field vectors are parallel and equation (1) can be solved for the angles $\alpha$, $\beta$, and $\gamma$. Only for large distances the angle $\phi$ between the two measured field vectors has to be included in the calculation (by a corresponding additional rotation), but at such large distances the object is likely out of sight and the user thus cannot direct the pointing vector to a surface being associated to a surface of the object.

Another external field that can be measured by both the object and the remote-control unit is the earth magnetic field. Again, for small distances (<1 km, preferably <100 m or even <10 m) it can be assumed that the magnetic field vectors of the earth magnetic field as measured by the object and by the remote-control unit at their respective positions are essentially parallel. The notion of "at small distances" of course depends on the location, close to the magnetic poles 1 km has a significant effect.

The invention may as well be used as safety measure during (semi-)autonomous operation of any kind of object, e.g. of a machine. For example a particular function of the machine may be stopped if the pointing vector does not point to a surface being defined in the first coordinate system.

During operation the surface may move relative to the second coordinate system and if the pointing vector follows the movement of said surface, the operation continues. If the pointing vector does not follow the movement, the user likely is diverted and the operation is stopped. Going back to the example of a car, the autonomous operation could be parking of the car. During that operation the user has to survey the movement. This can be verified by monitoring the direction of the pointing vector. If the pointing vector points towards a surface associated to the operation, the car continues driving into a parking slot, if the pointing vector does not follow the movement, the car stops as it is to assume that the user is diverted.

The position of the remote-control unit in the first coordinate system can be determined by trilateration. To this end the object may e.g. sequentially emit at least three signals from three different positions, i.e. a first signal from a first position, a second signal from a second position and third signal from a third position. The signals can be e.g. radio frequency signals, for example LF-signals. The remote-control unit receives the signals and determines the distances to the first, second and third position. Thereby, the position of the remote control unit can be determined as the intersecting point of spheres being centered at the first, second or third position hand having the first, second and third distance as radius, respectively. This scheme yields two possible intersecting points and thus positions, but one position can likely be excluded by plausibility, e.g. the remote-control unit should be at a height that corresponds the size of human users. Thus a position below the ground can be excluded as well as position to high to be likely the position of a remote-control unit being held by a human. Preferably, the object emits a fourth signal from a fourth position and the remote-control unit determines the distance to said fourth position. The intersecting point of a fourth sphere being centered at the fourth position and having the, fourth distance as radius with the other three spheres is unambiguous and can be used as estimate for the position of the remote control unit in the first coordinate system. Alternatively the remote-control unit may emit a signal being received by the antennas. Based on the received signal, the distances between the remote-control unit and the positions can be determined. In case of radio frequency signals there is at least one antenna at the first to third or fourth positions and the remote-control unit has at least one antenna.

As the received signal strength decays with increasing distance the distance can be determined from a measurement of the received signal strength. There are other methods for determining the distance between two antennas that can be used as well, e.g. time of flight measurements and the like.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
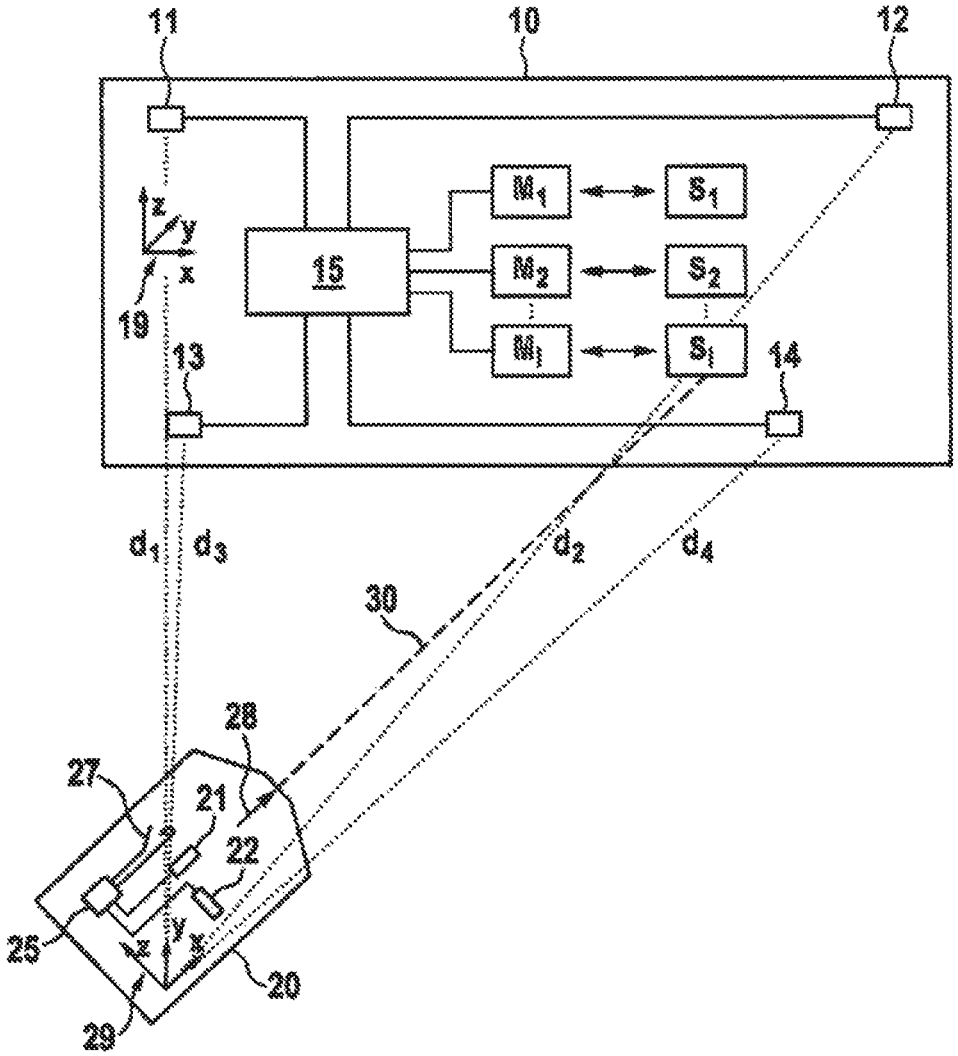
FIG. 1 shows a system with an object and a remote-control unit.

FIG. 1 shows an object 10 having a first function and optionally a second function or further functions, symbolized by actuators $M_1$, $M_2$ and $M_i$, respectively (i being an integer greater two). For example, if the object is a car, the first function could be to lock/unlock the left front door. $M_1$ would then represent the drive for actuating the door lock. $M_2$ could e.g. represent a drive for operating a trunk lid. Thus, the second function could be opening or closing a trunk by moving the trunk lid up or down. In the example, the object 10 has i functions, where i is an integer greater 2, but of course a single function that can be controlled by a remote-control unit 10 is sufficient to make use of the invention. In other words, generally i satisfies the relation $i \geq 1$.

For each function $M_1$, $M_2$, $M_i$, a surface $S_1$, $S_2$ and $S_i$ is defined in the first coordinate system 19. The surfaces $S_1$, $S_2$ and $S_i$ are associated to the respective functions. One could as well say that each function $M_j$ is linked with a surface $S_j$ ($j \leq i$). The information about the linkage could e.g. be stored in a lookup table. The surfaces $S_j$ may be selected to correspond in practice with the linked function, e.g. if the function $M_2$ is to raise or lower a window the surface $S_2$ being linked with said function could be a surface of said window. Or if a function $M_j$ is to open or close a trunk lid, the linked surface $S_j$ could be the trunk-lid's shell surface. The surfaces $S_j$ may not necessarily exactly represent the shell surface; it can as well be a projection of the item to control onto e.g. a plane (see Bronstein Semedjajev, *Handbook of Mathematics,* $5^{th}$ Ed. Springer Berlin Heidelberg 2007, Chapt. 3.3.1 and 3.5.4.3,). This reduces memory requirements and the numerical effort.

The first object 10 defines a first reference system, i.e. a first coordinate system 19 being 'attached' to the object 10. In this sense the first coordinate system 19 is the object's coordinate system. Its origin and orientation can be set arbitrarily, provided it does not move relative to the object.

A controller 15 of the object 10 is connected to four antennas 11 to 14 for emitting and/or receiving RF-signals (one of the four antennas is optional, additional antennas enable to enhance the precision of a distance measurement). The controller is as well connected to the actuators $M_1$, $M_2$ to $M_i$ for controlling the first and second functions in response to signals provided by a remote-control unit 20.

The remote-control unit 20 comprises as well a controller 25 which is connected to an antenna 21, 22 for receiving and/or transmitting RF-signals to thereby communicate with the object 10. The remote-control unit 20 defines a second reference system, i.e. a second coordinate system 29 being 'attached' to the remote-control unit may be defined. If the remote-control unit is carried around by a user or pivoted, the second coordinate system 29 moves relative to the first coordinate system 19 and a pointing vector 28 being defined in the second coordinate system moves accordingly. To ease directing the pointing vector 28 to a target, e.g. to one of the surfaces $S_j$, the remote-control unit may comprise a light source for emitting a light beam 30, being aligned or at least parallel to the direction of the pointing vector 28. A user may provide an activation command by actuating an input receiving means 27, which is symbolized in the figure by a switch 27.

For activating a particular function $M_j$, a user points with the pointing vector 28 to the corresponding surface $S_j$ and provides an activation command via the input receiving means. The orientation of the pointing vector 28 is determined by at least one of the controllers 15, 25 and if the pointing vector 28 points to one of the surfaces $S_j$, the associated function $M_j$ is activated, e.g. energized.

Figure 2:
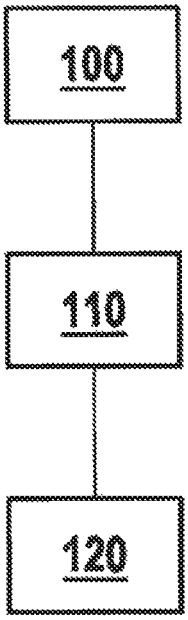
FIG. 2 shows a flow diagram of a method for using the system.

A method for determining if the pointing vector 28 points to one of the surfaces $S_j$ is shown in FIG. 2. In a first step 100 the first and second coordinate systems 19, 29 and the pointing vector 28 are defined. Next, e.g. upon an input provided to said input receiving means 27 the position $\vec{p}_{r_1}$ of the pointing vector 28 and its orientation $\vec{v}_{r_1}$ are determined in the first coordinate system (step 110). Based on the position $\vec{p}_{r_1}$ and the orientation $\vec{v}_{r_1}$ it is determined if the pointing vector 28 points towards one of the surfaces $S_j$. Only if the pointing vector 28 points to one of the surfaces $S_j$, the function $M_j$ being associated to said surface $S_j$ is activated. This is symbolized by step 120, referred to as activation step.

Figure 3:
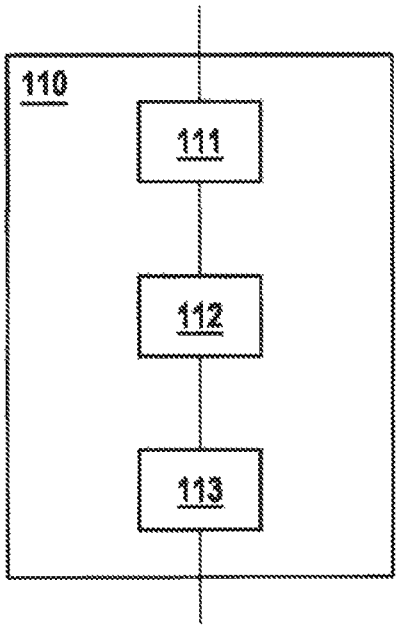
FIG. 3 shows a flow diagram of the determining step.

The determining step 110 may comprise at least some of the method steps shown in FIG. 3. In particular, the determining step 110 may comprise providing a first observable vector field by the object 10 or at least in the first coordinate system as indicated by box 111. Next, at the position $\vec{p}_r$ of the remote-control unit (e.g. of the pointing vector 28), the direction of a field vector $\vec{f}_2(\vec{p}_r)$ of said vector field is measured by the remote-control unit 20 in the second coordinate system (box 112). This can be obtained by corresponding directional antennas 21, 22. Only two antennas are depicted, but of course at least three are preferred to fully determine spatial orientation of the vector field at the position of the remote control unit. This measured field vector $\vec{f}_2(\vec{p}_r)$ is compared (represented by box 113) to a predicted field vector $\vec{f}_1(\vec{p}_r)$ at the position of the remote-control unit 20 to thereby determine the rotation R for aligning the first coordinate system 19 with the second coordinate system 29, briefly R can be determined from $$R\vec{f}_1(\vec{p}_r)=\vec{f}_2(\vec{p}_r), \tag{1}$$

wherein R is the corresponding rotary matrix, $\vec{f}_1(\vec{p}_r)$ is the predicted field vector at $\vec{p}_r$ and $\vec{f}_2(\vec{p}_r)$ is the measured field vector at $\vec{p}_r$. Again, the field vectors $\vec{f}_1(\vec{p}_r)$, $\vec{f}_2(\vec{p}_r)$ can be considered to be normalized, because they must have the same length.

Preferably, first the location $\vec{p}_r$ of the remote-control unit 20 in the first coordinate system 19 and the corresponding measured field vector $\vec{f}_2$ are determined as well in step 111. For example the location $\vec{p}_r$ of the remote-control unit 20 in the first coordinate system can be determined using trilateration: To this end each of the antennas 11 to 14 (see FIG. 1) broadcasts a signal which is received by the remote-control unit 20, e.g. using at least one of the antennas 21, 22. Based on the signal strength indicator (RSSI-value) of the signals the distance from the remote-control unit to the respective antenna 11 to 14 is calculated. The distances $d_1$ to $d_4$ enable to locate the remote control unit 20 in the first coordinate system and thereby $\vec{p}_{r_1}$. The signals for the distance measurements can be transmitted sequentially to be able to clearly distinguish them. Alternatively a clear distinction is possible if the signals are sent at different frequencies.

Figure 4:
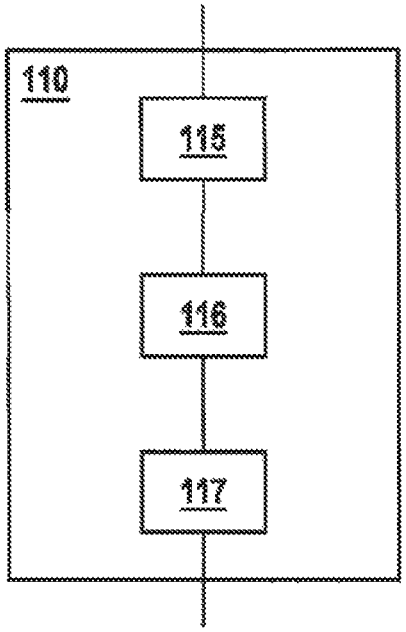
FIG. 4 shows a flow diagram of an alternative determining step.

In an alternative embodiment the method step 110 may comprise measuring a vector of an external vector field by the remote-control unit and by the object (box 115, see FIG. 4) again these measurements can be represented by field vectors $\vec{f}_1$, $\vec{f}_2$. For example, both could be representative for the direction of the (earth) gravity field. The gravity field can be measured very easily by acceleration sensors, provided that the acceleration vector of the object or the remote control unit relative to the earth is zero or known. It may be assumed, that the two measured gravity field vectors are parallel and the equation (1) can be solved for the angles α, β, and γ. Only for large distances the angle ϕ between the two measured field vectors has to be included in the calculation (by a corresponding additional rotation), but at these distances the object is likely out of sight and the user thus cannot direct the pointing vector to a surface being associated to a surface of the object. If not already known at the position $\vec{p}_r$ of the remote-control unit (i.e. of the pointing vector) is measured as well. These measured field vectors $\vec{f}_1$, $\vec{f}_2$ are compared (box 116) to thereby determine the rotation R for aligning the first coordinate system 19 with the second coordinate system 29, briefly R can be determined from $$R\vec{f}_1=\vec{f}_2.$$

As soon as the rotation R is determined, it can be determined very easily if the pointing vector points to at least one of the surfaces $S_j$. Of course the method may comprise the determining step as explained with respect to FIG. 3 and the determining step as explained with respect to FIG. 4. In this case one obtains two matrices and thus two values for each angle of rotation. The angles can be compared and accepted only if the difference between the angles is below a predefined maximum. In this case one may continue e.g. with the mean of the corresponding angles or with the result of one of the determining steps (optional step 117).

LIST OF REFERENCE NUMERALS

10 object, e.g. a car, boat, machine
11 antenna
12 antenna
13 antenna
14 antenna
15 controller
19 first coordinate system
20 remote-control unit
21 antenna
22 antenna
25 controller
27 input receiving means (e.g. switch)
28 pointing vector
29 second coordinate system
30 light beam
100 definition step
110 determining step
111 providing a first observable vector field
112 measuring the direction of a field vector
113 determining the rotation R for aligning the first coordinate system 19 with the second coordinate system 29
115 measuring a vector of an external vector field by the remote-control unit and by the object
116 comparing the measured field vectors to determine the rotation R for aligning the first coordinate system 19 with the second coordinate system 29
117 comparing the angles of rotation (optional)
120 activation step
$M_1$ first function
$M_2$ second function
$M_i$ $i^{th}$ function
$S_1$ first surface
$S_2$ second surface $S_i$ $i^{th}$ surface
$d_1$ distance
$d_2$ distance
$d_3$ distance
$d_4$ distance

The invention claimed is:

1. A method for remote controlling an object with a remote-control unit, comprising the steps of:

defining at least a first surface ($S_1$, $S_2$, $S_i$) in a first coordinate system, wherein the first coordinate system is the object's coordinate system, associating at least a first function ($M_1$, $M_2$, $M_i$) of said object to said first surface ($S_1$, $S_2$, $S_i$), defining a second coordinate system at the position of the remote-control unit, wherein the second coordinate system is the remote-control unit's coordinate system, defining a static pointing vector in said second coordinate system, determining if the pointing vector points towards said first surface ($S_1$, $S_2$, $S_i$), generating at least a first electromagnetic field by the object, providing predicted information about the spatial orientation of an electric and/or magnetic field vector of said first electromagnetic field at the position of the remote-control unit in the first coordinate system, measuring the spatial orientation of the predicted magnetic and/or electric field vector at the position of the remote-control unit by the remote-control unit in said second coordinate system, obtaining the representation of the pointing vector in the first coordinate system from an annular relation between the measured spatial orientation and the predicted spatial orientation of the electric and/or magnetic field vector, and activating said first function ($M_1$, $M_2$, $M_i$) by the object upon receipt of an activation command only if the pointing vector points towards said first surface ($S_1$, $S_2$, $S_i$).

2. The method of claim 1, further including the step of:

determining the position of the remote-control unit in the object's coordinate system.

3. The method of claim 1 further including the steps of:

associating at least a second function ($M_2$) to a second surface ($S_2$), activating said second function ($M_2$) by the object upon receipt of an activation command, only if the pointing vector points towards said second surface ($S_2$).

4. The method of claim 3 wherein a single activation command enables to activate at least the first and second functions ($M_1$, $M_2$, $M_i$) of the object and only those of said functions ($M_1$, $M_2$, $M_i$) are activated which are associated to surfaces ($S_1$, $S_2$, $S_i$) to which the pointing vector points to.

5. The method of claim 3 further including the step of:

testing if the pointing vector points towards the first surface ($S_1$) and the second surface ($S_2$) and at least one of:

activating the first function ($M_1$) only if the remote-control unit is closer to the first surface ($S_1$) then to the second surface ($S_2$) and activating the second function ($S_2$) only if the remote-control unit is closer to the second surface ($S_2$) than to the first surface ($S_2$).

6. The method of claim 1 wherein a minimum and/or a maximum distance is associated to the at least one first surface ($S_1$, $S_2$), and wherein that the activation step further comprises testing if the distance of the remote-control unit to a reference point in the first coordinate system or a third coordinate system is larger than the minimum distance and/or smaller than the maximum distance and activating the function ($M_1$, $M_2$, $M_i$) associated to the at least one first surface ($S_1$, $S_2$, $S_i$), only if the distance is larger than the minimum distance and/or smaller than the maximum distance.

7. The method of claim 1 further including the step of:

defining a front and a rear side of the first surface ($S_1$, $S_2$, $S_i$) and activating the first function ($M_1$, $M_2$, $M_i$) only if the pointing vector (28) points to a predefined of said first and rear sides.

8. The method of claim 1 wherein the pointing vector is visualized by a light beam being emitted by the remote-control unit in the direction of the pointing vector.

9. The method of claim 1 further including the step of:

visualizing or otherwise indicating if the pointing vector points towards said first surface ($S_1$, $S_2$, $S_i$) prior to receiving an activation command by at least one of:

a. illuminating an item of the object, wherein the item is associated to the first function, if the pointing vector points to the first surface ($S_1$, $S_2$, $S_i$), b. activating an indication means of the remote-control unit, wherein the indication means is associated to the first function, if the pointing vector points to the first surface ($S_1$, $S_2$, $S_i$).

10. The method of claim 1 wherein the first function ($M_1$, $M_2$, M) is only activated if the pointing vector points towards a predefined side of the first surface.

11. The method of claim 1 further comprising the steps of:

transmitting at least one of the measured electric, magnetic field vector to the object, the predicted electric, and magnetic field vector to a controller of the remote-control unit, determining the rotation for aligning the first and second coordinate systems, applying the determined rotation to the representation of the pointing vector in the second coordinate system to thereby obtain its representation in the first coordinate system, determining, if the pointing vector points towards said at least one first surface ($S_1$, $S_2$, $S_i$) based on its representation in the first coordinate system.

12. The method of claim 1 further comprising the steps of:

measuring the orientation of the at least one external reference vector by the remote-control unit in the second coordinate system, compensating for imperfections in the measurement of the orientation of the at least one external reference vector by the remote-control unit in the second coordinate system based on the orientation of the at least one external reference vector measured by the remote-control unit and an assumption about the orientation of the at least one external reference vector in the first coordinate system.

13. The method of claim 1 wherein the determining step further comprises:

determining the orientation of at least one external reference vector by the object in the first coordinate system, measuring the orientation of the at least one external reference vector by the remote-control unit in the second coordinate system, determining the rotation for aligning the at least one an external reference vector in the representation in the first coordinate system as measured by the object with the at least one external reference vector in the representation in the second coordinate system as measured by the remote-control unit, and applying the determined rotation to the representation of the pointing vector in the second coordinate system to thereby obtain its representation in the first coordinate system, and determining, if the pointing vector points towards said at least one first surface ($S_1$, $S_2$, $S_i$)) based on its representation in the first coordinate system.

* * * * *